United States Patent [19]

Pike et al.

[11] Patent Number: 4,854,760

[45] Date of Patent: Aug. 8, 1989

[54] DISPOSABLE CONTAINER WITH APPLICATOR

[75] Inventors: Brian R. Pike, Oceanside; Patrick J. Furlong, La Costa; John W. Moers, Fallbrook, all of Calif.

[73] Assignee: Unidec, Carlsbad, Calif.

[21] Appl. No.: 25,609

[22] Filed: Mar. 13, 1987

[51] Int. Cl.[4] ..... A46B 11/00; A45D 34/00; A61M 35/00

[52] U.S. Cl. ..... 401/134; 401/132; 401/271; 401/288; 604/3; 222/83

[58] Field of Search ..... 401/271, 186, 288, 132–135; 604/3; 222/83, 83.5, 541

[56] References Cited

U.S. PATENT DOCUMENTS

| | | | |
|---|---|---|---|
| 1,688,236 | 10/1928 | Horn | 401/134 |
| 2,642,064 | 6/1953 | Laushe | 222/83 X |
| 3,759,259 | 9/1973 | Truhan | 401/132 X |
| 4,027,985 | 6/1977 | Loesser, III | 401/134 |
| 4,040,753 | 8/1977 | Griffith | 401/186 |
| 4,131,217 | 12/1978 | Sandegren | 222/83.5 X |
| 4,148,318 | 4/1979 | Meyer | 401/134 X |
| 4,657,159 | 4/1987 | Grant | 222/83 |
| 4,696,328 | 9/1987 | Rhodes, Jr. | 222/541 X |

FOREIGN PATENT DOCUMENTS

| | | | |
|---|---|---|---|
| 342770 | 10/1921 | Fed. Rep. of Germany | 401/135 |
| 2440413 | 4/1975 | Fed. Rep. of Germany | 401/132 |
| 1283992 | 1/1962 | France | 401/134 |
| 2231337 | 12/1974 | France | 401/186 |

*Primary Examiner*—Steven A. Bratlie
*Attorney, Agent, or Firm*—Lyon & Lyon

[57] ABSTRACT

A disposable container for application of paints, medicaments and coatings having a compressible hollow body with a closed end and a membrane sealed open end, and a stationary applicator housing fitted on the membrane sealed open end so that when the hollow body containing liquid is compressed, the membrane is punctured or fractured and the liquid is supplied to the applicator.

13 Claims, 2 Drawing Sheets

FIG. 2.
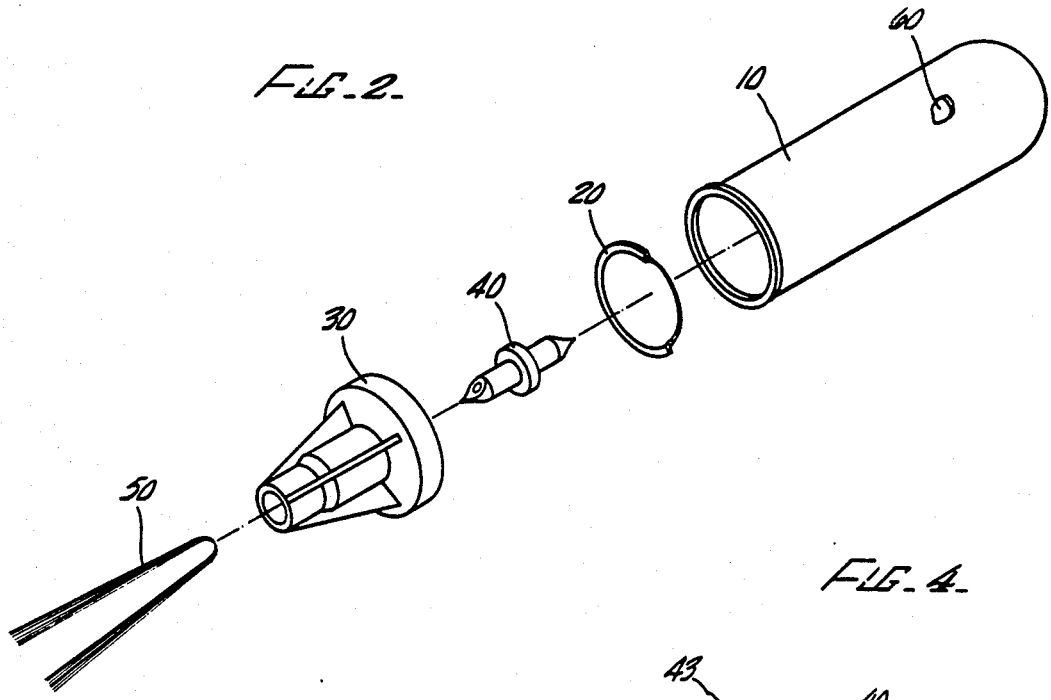
FIG. 4.
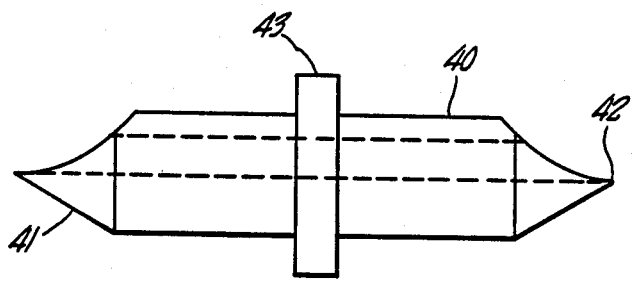
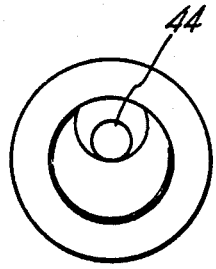
FIG. 5.

DISPOSABLE CONTAINER WITH APPLICATOR

FIELD OF THE INVENTION

The field of the invention is applicators for paints, medicaments and coatings.

BACKGROUND OF THE INVENTION

A requisite for the maintenance of fluids is that they be sealed within a container sufficient to prevent them from breaking down, evaporating, or drying out. A requisite for a disposable container is that it be simple and economical to manufacture and easy to use.

In U.S. Pat. No. 4,599,008, issued July 8, 1986, for a "Fingernail Polish Capsule and Plunger," the disclosure of which is incorporated herein by reference, there is described a sealed unit in the form of a cartridge containing nail polish, a slidable brush attachment, a piston, and a plunger. It is to be used in a reusable handpiece. When the cartridge is placed into the handpiece, the brush attachment slides axially to automatically force open a panel at one end of the cartridge, that end being closed by a separately formed plug which has a sealed fit in the cartridge. Next, a plunger is utilized to displace a removable panel at the opposite end of the cartridge. That removable panel sits on a piston and is moved into the cartridge by further movement on the plunger which also moves the piston, thereby forcing the liquid nail polish into the brush attachment.

As noted therein, nail polish is customarily sold in bottles with the closure cap having an attached brush which is used to apply the polish. Such bottles contain more polish than is required for a single application so that after use the bottle must be reclosed and stored. Various techniques have been adapted to store such containers, including placing them in refrigerators. It is remarked that there has, however, been no satisfactory and convenient solution to solvent loss. In fact, it is stated, there is a solvent loss in the customary nail polish bottle arrangement during storage. While the invention of the '008 patent is said to solve that solvent loss problem, it has been discovered that various aspects of the device disclosed therein make its use as a disposable application unit inconvenient and expensive. First, the device is complicated from a standpoint of manufacture, containing a number of intricate parts. Additionally, the '008 device must be used with a plunger-containing handpiece.

SUMMARY OF THE INVENTION

The invention herein relates to a self-contained disposable, fluid storing applicator device which is easy to manufacture and use and which need not be used with a handpiece. Optionally, a mechanical dispenser device may be relied on by the user to expel the contents of the container. The container may be used to store and apply or otherwise expel a variety of materials, such as paint, nail polish, and medicaments, including smelling salts and topical pharmaceuticals like iodine.

With the above and other objects hereinafter set forth in view, the invention will be more clearly understood by reference to the following detailed description and the several accompanying drawings.

BRIEF DESCRIPTION OF THE DRAWINGS

FIG. 3 is a cross-sectional side view of the brush end of the embodiment of FIG. 1 prior to use.

FIG. 4 is a side view of the brush retainer and membrane piercing device of FIG. 1.

FIG. 5 is an end view of the device of FIG. 4.

DETAILED DESCRIPTION OF THE PREFERRED EMBODIMENT

Figure 1:
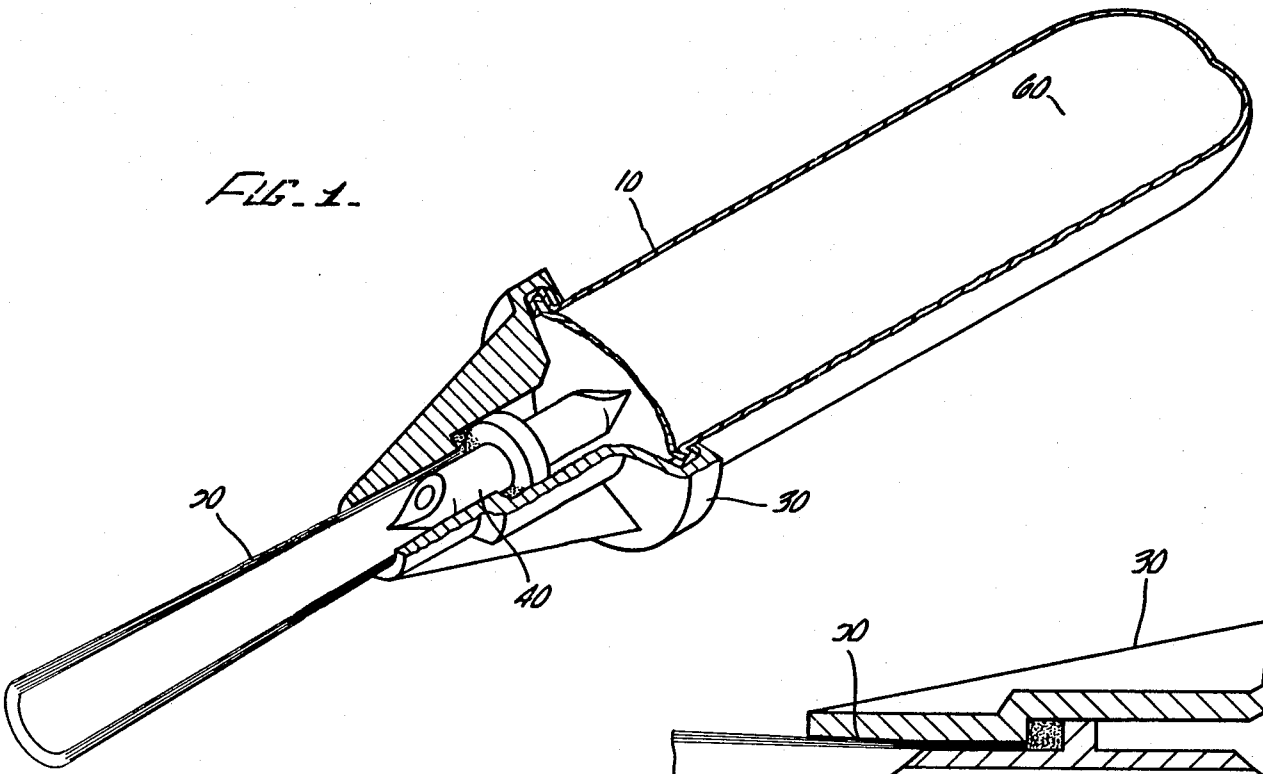
FIG. 1 is an oblique view of an embodiment of the present invention.

Referring now to the drawings in detail, it will be seen that there is illustrated in FIG. 1 a disposable container with an attachment for application of the contents stored in capsule 10. The capsule may be formed of any material sufficient to prevent significant breakdown or loss of its contents and enable the user to apply pressure to the outside of the capsule, either by hand or mechanically, to distort the capsule without breaking said capsule. Thus, the capsule may be formed of a material such as thin-walled aluminum (e.g., 1100 series aluminum) or brass—or from a plastic material that is lined with another material or metal, such as aluminum or brass—which prevents significant loss or breakdown of the contents. Preferably the capsule wall thickness increases just before the open end. The capsule may also be "dimpled" to more reliably predict the configuration in which the capsule will be collapsed by applied pressure.

The capsule is shown to be closed by a sealing membrane (or diaphragm) 20 seated on a flanged edge of the capsule. The membrane may also be integral with applicator housing 30, the latter then serving to close and seal the capsule.

The membrane may be made of any suitable material, such as thin gauge aluminum. The gauge of the membrane may be thinned in the center of a dished cavity extending over a major portion of the diameter. This part may or may not be annealed. In the embodiment shown, it is preferred that the capsule is annealed and the membrane is not.

As pressure is placed on the capsule, the contents 60 are forced forward against the membrane which is flexed forward and pierced by one end of the applicator retainer 40. The contents may then be moved through an opening or channel in the applicator retainer to supply the applicator 50 which in the present embodiment comprises an array of fibers for use in application. As an alternative to piercing, or additionally, the membrane may also be designed with, for example, pre-formed stress lines that would fracture when the capsule is squeezed.

Figure 2:
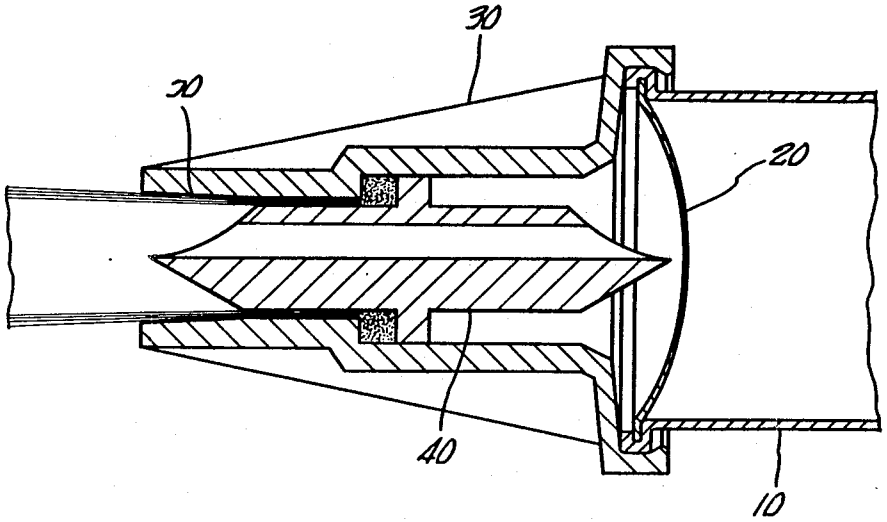
FIG. 2 is an oblique exploded assembly view of the embodiment of FIG. 1.

FIG. 2 shows an exploded assembly view of the FIG. 1 embodiment. The applicator housing 30 may be made of injection molded plastic such as polypropylene. It is designed to function as the outer structure of the applicator sub-assembly and, in this embodiment, defines the flare of an exposed fiber array that can be used as a brush applicator. It cooperates with the crimped head of the capsule 10 sub-assembly to provide mechanical attachment, and its internal passage diameter may cooperate with the external diameter of the applicator retainer 40 and the appropriate amount of applicator material, for example, brush fibers, to form a press fit sufficient to permanently engage those fibers. The applicator housing also defines the spatial relationship between the rearward point of an appropriately sized retainer and the surface of the membrane or diaphragm 20. Finally, it creates a fluid tight seal between the two subassemblies at the point of attachment.

The applicator retainer 40 is such that the forward point of the retainer, in the case of a brush applicator, properly divides the looped end of the fiber bundle that protrudes through applicator housing internal bore prior to the insertion of the retainer during assembly. The external diameter of the retainer cooperates with the applicator housing and the applicator to create a press fit that anchors the applicator, for example, brush fibers. The rearward point of the retainer is designed to pierce the membrane when the membrane is flexed forward during initial activation of the capsule. The internal passage of the retainer provides a conduit for fluid to exit the capsule and enter the applicator. The radial flange in the center of the retainer compresses, for example, in the case of a brush applicator, fiber loops. This contributes to the mechanical lock which anchors the fibers. The radial flange on the retainer also provides a peripheral seal in the internal bore of the applicator housing that prevents the flow of fluid onto the applicator except through a provided passage. Finally, it serves as a mechanical guide in cooperation with the internal bore of the applicator housing to center the retainer during assembly.

The fibers shown in the preferred embodiment may, at least when used for the application of nail polish, be of a nylon such as that sold by E.I. duPont de Nemours under the trademark designation TYNEX, which may be obtained on spools of predetermined strand count. The applicator may also be made from roving, bristles, non-woven materials, woven materials, paper, cotton, and plastic or natural sponge.

Referring now to FIG. 3, the applicator housing 30 is shown which is designed to be secured circumferentially about the edge of the open end of capsule 10. By way of example, the applicator housing is shown to be attached to the crimped edge of capsule. The applicator housing is shown to contain fibers 50 which are secured in part by retainer 40 through a radial press fit of the externally-oriented end of said retainer against the internal portion of the applicator housing.

Referring to FIGS. 3, 4 and 5, it is seen that retainer 40 may be generally circumferential and tapered at both ends. It may also be designed with a collar or flange 43 for sealing, as shown, and is preferably axially symmetrical to enhance the assembly procedure. As noted, the internally-oriented tapered end 42 is useful in piercing membrane 20, and the externally-oriented tapered end 41 is useful, for example, in separating roving or fibers during manufacture. FIG. 5 shows the internal passage 44 of the retainer which serves to permit the fluid to move from the capsule to the applicator during use.

The above embodiment is described to assist in understanding the invention and should not, of course, be construed as specifically limiting the invention. Such variations of the invention which would be within the purview of those in the art and all equivalents now known or later developed are to be considered to follow in the scope of the invention as hereinafter claimed.

We claim:

1. A dispenser comprising a compressible hollow body having a closed end and an open end, said open end being sealed by a membrane and having attached thereto a stationary fitted housing, said fitted housing having a means for applying a liquid and a stationary means for puncturing said membrane, so that when said hollow body containing said liquid is compressed said membrane is punctured and said liquid can be supplied to said means for applying a liquid.

2. The dispenser of claim 1 wherein said compressible hollow body is made of aluminum.

3. The dispenser of claim 1 wherein said compressible hollow body is generally oval or cylindrical in cross section and said closed end is generally dome shaped or flattened.

4. The dispenser of claim 1 wherein said open end of said compressible hollow body has an edge formed to retain said membrane and said stationary fitted housing.

5. The dispenser of claim 1 wherein said membrane is fitted within said stationary fitted housing.

6. The dispenser of claim 1 wherein said means for applying a liquid is selected from the group consisting of roving, fibers or bristles, non-woven materials, woven materials, paper, cotton, and plastic or natural sponge.

7. The dispenser of claim 1 wherein said means for puncturing is fitted within said housing to assist in retaining said means for applying a liquid.

8. The dispenser of claim 7 wherein said means for puncturing further comprises a communicating passage for supply of said liquid to said means for applying a liquid.

9. The dispenser of claim 8 wherein said means for puncturing is axially symmetrical.

10. The dispenser of claim 9 wherein said means for puncturing is reversible.

11. The dispenser of claim 8 wherein said communicating passage comprises a longitudinal bore extending through it from end to end.

12. The dispenser of claim 7 further comprise a membrane-oriented end which is tapered or pointed.

13. A dispenser comprising a compressible hollow body having a closed end and an open end, said open end being sealed by a non-fracturable membrane and having attached thereto a stationary fitted housing, said fitted housing having a means for applying a liquid and membrane piercing means so that when said hollow body containing said liquid is compressed said membrane is pierced and said liquid can be supplied to said means for applying a liquid.

* * * * *

UNITED STATES PATENT AND TRADEMARK OFFICE

CERTIFICATE OF CORRECTION

PATENT NO. : 4,854,760

DATED : Aug. 8, 1989

INVENTOR(S) : Pike et al.

It is certified that error appears in the above-identified patent and that said Letters Patent is hereby corrected as shown below:

Column 4, lines 45 and 46, claim 12 should read as follows:

12. The dispenser of claim 7 wherein said means for puncturing further comprise a membrane-oriented end which is tapered or pointed.

Signed and Sealed this

Fourteenth Day of July, 1992

*Attest:*

DOUGLAS B. COMER

*Attesting Officer*

*Acting Commissioner of Patents and Trademarks*